US006543546B2

(12) United States Patent
Kaiser

(10) Patent No.: US 6,543,546 B2
(45) Date of Patent: Apr. 8, 2003

(54) SAFETY SLIP RAM

(75) Inventor: Garry R. Kaiser, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/171,159

(22) Filed: Jun. 13, 2002

(65) Prior Publication Data

US 2002/0148618 A1 Oct. 17, 2002

Related U.S. Application Data

(63) Continuation of application No. 09/662,971, filed on Sep. 15, 2000, now abandoned.
(60) Provisional application No. 60/155,396, filed on Sep. 22, 1999.

(51) Int. Cl.[7] ..... E21B 19/00; E21B 19/10
(52) U.S. Cl. ..... 166/382; 166/75.11; 166/75.14; 188/67
(58) Field of Search ..... 166/382, 244.1, 166/75.11, 75.14, 243; 251/1.1, 1.3; 188/67

(56) References Cited

U.S. PATENT DOCUMENTS 1,802,565 A * 4/1931 Lacey ..... 137/560
2,105,636 A 1/1938 Creed
2,301,625 A 11/1942 Johnson
2,542,302 A * 2/1951 Barker ..... 285/123.11
3,472,535 A * 10/1969 Kinley ..... 188/67
3,692,107 A * 9/1972 Slator et al. ..... 166/298
4,043,389 A * 8/1977 Cobb ..... 166/55
5,009,289 A * 4/1991 Nance ..... 188/67
5,013,005 A 5/1991 Nance
5,203,408 A 4/1993 Boscher
5,575,451 A 11/1996 Colvin et al.
5,992,801 A 11/1999 Torres

* cited by examiner

*Primary Examiner*—Hoang Dang
(74) *Attorney, Agent, or Firm*—Steve Rosenblatt

(57) ABSTRACT

A pair of ram blocks are provided such that when they are actuated hydraulically to move together, they present an opening which has a series of gripping members downwardly biased. Removal of tubulars or tools from the well bore works against the bias to retract the grippers so that removal can be accomplished. However, if there is an accidental release, the bias pushes the grippers toward the tubular or tool to grip it to prevent loss into the well bore. The ram blocks can be retracted for run-in to the well bore.

11 Claims, 2 Drawing Sheets

SAFETY SLIP RAM

This application is a continuation application of U.S. patent application Ser. No. 09/662,971, filed on Sep. 15, 2000, now abandoned, which claims priority from the U.S. Provisional Application No. 60/155,396, filed on Sep. 22, 1999.

FIELD OF THE INVENTION

The field of this invention relates to devices that can grip tools and prevent them from falling into a well bore during attempted removal.

BACKGROUND OF THE INVENTION

In oil field operations, various tools are extremely long and are taken apart joint by joint as they are removed from the well bore. The well bore typically has a blow out preventor through which the tubulars are to be removed. Techniques have been developed to deploy and remove tools in a live well. These devices grip the string in the well bore and seal off the well bore allowing disassembly of a component above the seal. Thereafter, some sort of gripping tool grabs the remaining portion of the assembly that extends in the hole before the lower support is retracted. Once the lower support is retracted, the next joint can be pulled through the blowout preventor and the ram and seal assembly can then be actuated to again support the string and seal off the well bore. The problem arises when the running or gripping tool that is supposed to suspend the string when the support ram is opened does not have a good grip on the string and a release results. Many oil field operators have experienced a loss of equipment downhole when the lower support for the string above the blowout preventor released but the string was not otherwise supported.

Thus, an objective of the present invention is to provide a simple readily installable mechanism for the blowout preventor to prevent loss of equipment for tubulars downhole. The device is self-actuating and permits removal while at the same time catching the string should there be an accidental disconnect at or above the blowout preventor.

In the past, a blowout preventor design involving rams with a series of gripping devices has been used to permit insertion of tubulars into a well bore that is experiencing a blowout. In those conditions, it was desirable to have a mechanism which would keep the downhole tools or tubulars from blowing out of the well after they were inserted beyond the blowout preventor. Accordingly, one prior design employed gripping devices in a blowout preventor which permitted insertion of tubulars into a well blowing out with a feature to automatically prevent them from coming out. Yet despite the existence of this device, numerous large oil field service companies have experienced the unpleasant effects of dropping tools or tubulars in the process of removing them from the well bore.

Accordingly, what has been needed and what this invention provides is a simple economical and reliable technique to prevent losing tubulars and tools downhole during the removal process.

SUMMARY OF THE INVENTION

A pair of ram blocks are provided such that when they are actuated hydraulically to move together, they present an opening which has a series of gripping members downwardly biased. Removal of tubulars or tools from the well bore works against the bias to retract the grippers so that removal can be accomplished. However, if there is an accidental release, the bias pushes the grippers toward the tubular or tool to grip it to prevent loss into the well bore. The ram blocks can be retracted for run-in to the well bore.

DETAILED DESCRIPTION OF THE PREFERRED EMBODIMENT

Figure 1:
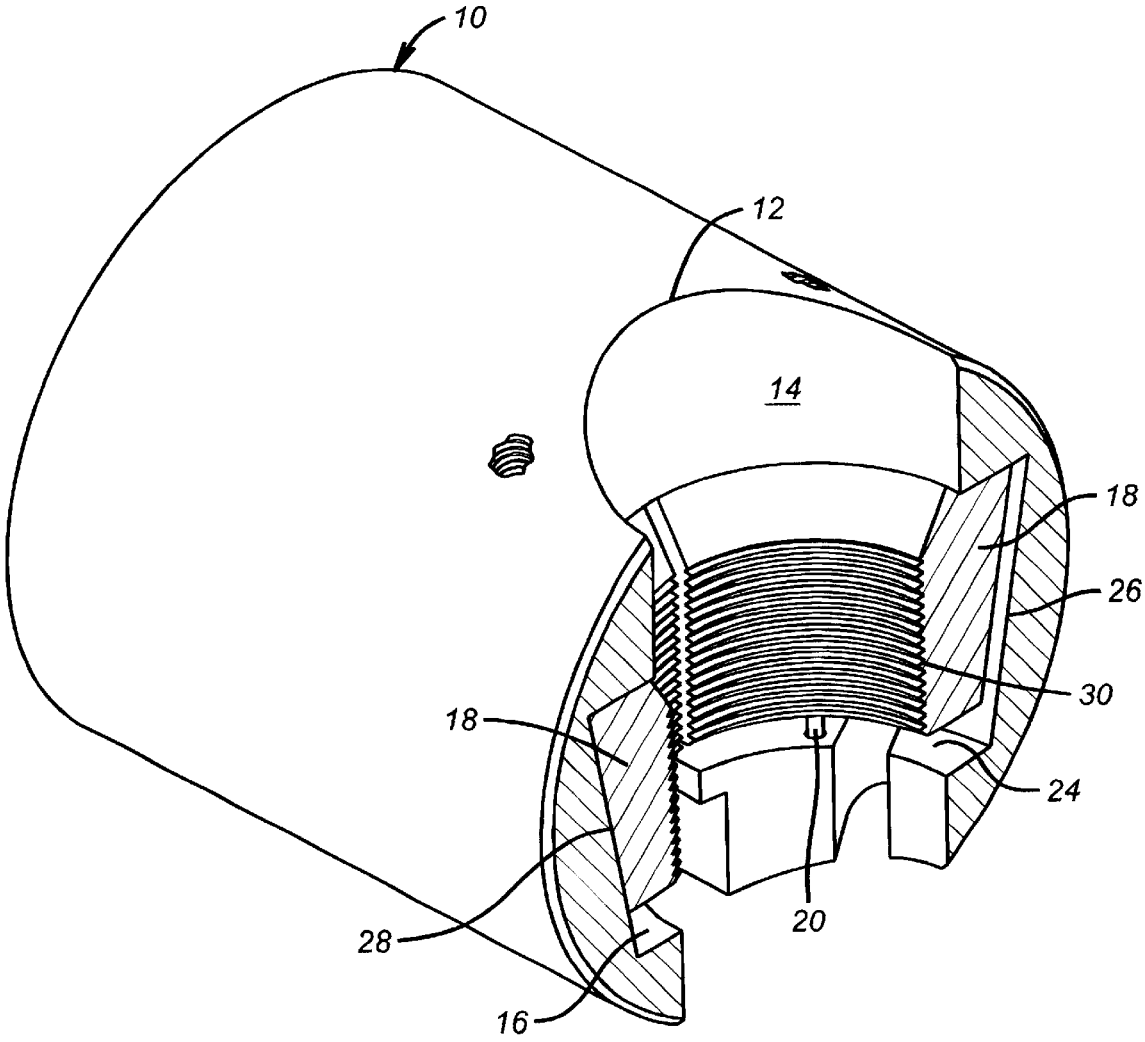
FIG. 1 is an isometric view showing the ram block with gripping members pushed up against the bias to allow tubular goods or downhole tools to be removed.
Figure 2:
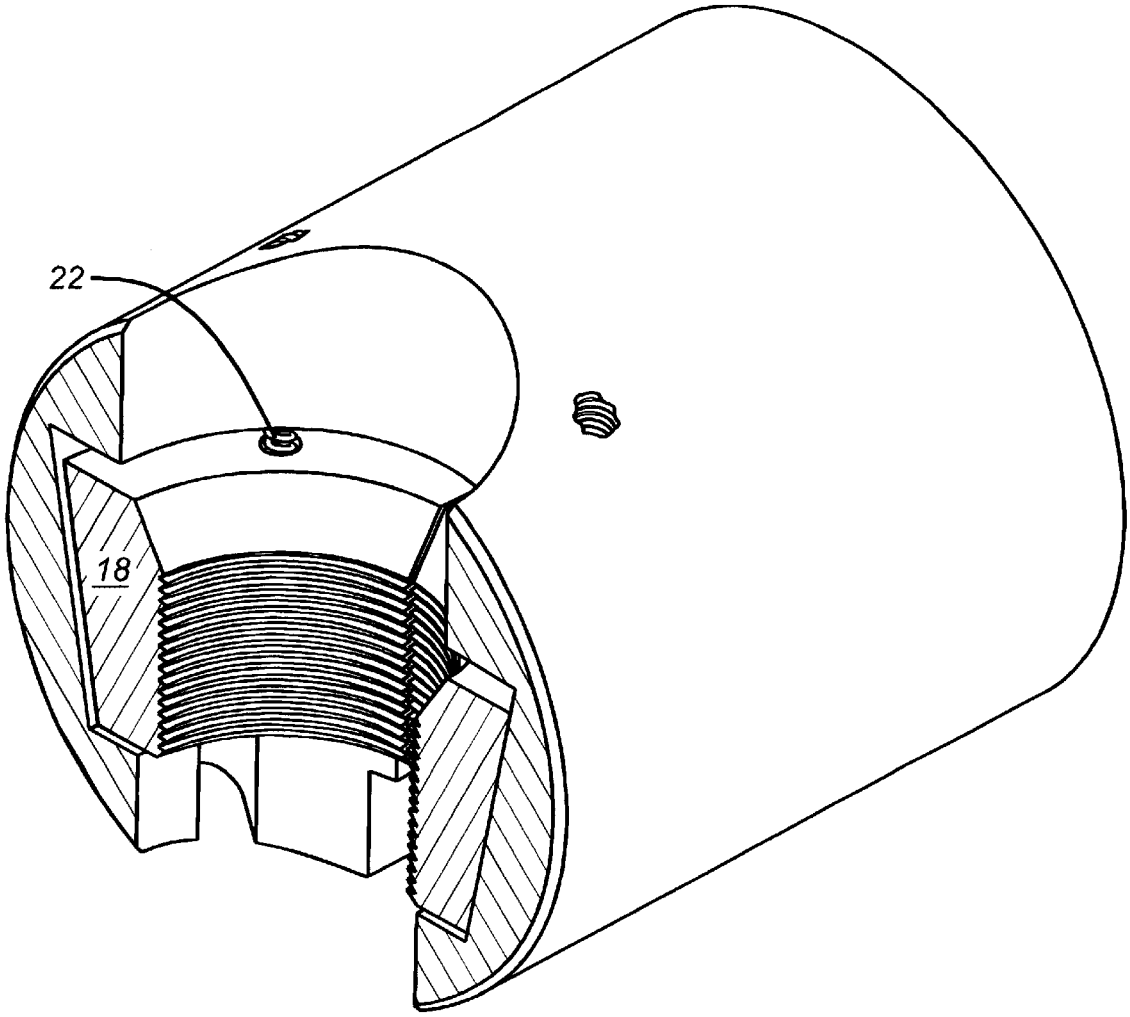
FIG. 2 is the view of FIG. 1 showing the position of the gripping devices if the tubular or downhole tools begin to fall in a downhole direction.

FIG. 1 illustrates a ram block 10. Ram block 10 is used in pairs in a blowout preventor (not shown). When the ram blocks 10 are pushed together, the semi-circular opening 12 in each ram block helps to define a bore 14 for which the tubulars or downhole tools are removed from the well bore As shown in FIG. 1, there is a peripheral recess 16 in each ram block 10. The peripheral recess holds a plurality of slips 18 which are free to move up and down within recess 16 on guide posts 20. Springs 22 shown in FIG. 2 bias the slips 18 downwardly toward surface 24. In the position shown in FIG. 1, a pipe tubular or downhole tool is being pulled out of the well bore. Contact is made by that object on its way out of the well bore with the slips 18 which puts an upward force on the slips 18. The slips 18 are displaced upwardly compressing springs 22. Because of the tapered shape of surface 26 and the matching taper on surface 28 of the slips 18, upward displacement of slips 18 also results in outward displacement of slips 18. The outward displacement of slips 18 then makes available a bore 14 sufficiently large for extraction of the tubular or downhole tool through the bore 14. On the other hand, if there is an inadvertent release above the ram blocks 10 during the removal procedure, the springs 22 will bias the slips 18 downwardly such that the serrations 30 will bite into the pipe or downhole tool and retain it and any portion of the string below from falling into the well bore. The position shown in FIG. 2 illustrates where the slips 18 can be found when they are catching the pipe or downhole tool preventing its dropping down the wellbore.

Those skilled in the art will appreciate that other mechanisms can be used to bias the slips 18 into contact with the object passing through them to prevent its dropping into the well bore. While springs 22 have been shown because of simplicity, other devices can be used such as hydraulic actuation. The gripping surface or serrations 30 can be varied without departing from the spirit of the invention. What is simply needed is sufficient gripping force to prevent the loss of the string or tools down the well bore. While the slips 18 have been shown to be in a semi-circular groove, each slip 18 can be placed in its own independent recess and the ram block 10 can actually be used to guide the slips 18 in place of the guide posts 20 which emerge from surface 24 and go into a bore in the lower surface of the slips 18 as shown in FIG. 1. The number of slips 18 that are used can be varied. The slips can pivot as opposed to sliding.

The essence of this invention is its shear simplicity and its reliability of operation. Since a release is a sudden event, a mechanism to catch the object before it falls into the well bore is only effective if it can be fast reacting. The preferred embodiment of the invention as described above meets these qualifications and presents a design which is simple to build and requires no operator input for effectively catching an inadvertently released tool or tubular.

Those skilled in the art will appreciate that for years dropping tools or tubulars in the well bore has been a serious problem for oil field service companies and for each client, well owner. Yet despite any tools previously available, tubulars and tools continued to drop in the well bore. The apparatus of the present invention is designed to eliminate this problem effectively and simply.

It should be noted that only the preferred embodiment has been described and modifications of the above-described preferred embodiment can be made by those skilled in the art without departing from the spirit of the invention.

I claim:

1. A method for preventing accidental dropping of a tubular into a wellbore comprising:

removing the tubular through a blowout preventor;

configuring said blowout preventor to allow removal of the tubular while preventing dropping of the tubular into the wellbore;

providing a selective gripping mechanism on at least one of the ram blocks of said blowout preventor;

maintaining sliding contact between said selective gripping mechanism and the tubular as the tubular is removed from the wellbore.

2. The method of claim 1, comprising:

providing a selective gripping mechanism on a pair of opposed ram blocks;

advancing said ram blocks into contact;

defining an opening between said ram blocks;

locating said selective gripping mechanism in said opening.

3. The method of claim 2, comprising:

wedging the tubular to said ram blocks with said selective gripping mechanism if the tubular begins to move in a downhole direction.

4. The method of claim 3, comprising:

providing at least one cammed gripper in each ram block as said selective gripping mechanism.

5. The method of claim 4, comprising:

providing a sloping surface in each ram block so that a movement of the tubular in a downhole direction pulls said cammed grippers toward each other along their respective sloping surfaces.

6. The method of claim 5 comprising:

providing a bias on each cammed gripper to push it down said sloping surface and towards an opposing cammed gripper to facilitate sliding contact with the tubular when the tubular is moved out of the wellbore.

7. The method of claim 6, comprising:

using said bias on movement of the tubular in a downhole direction to initiate gripping of the tubular by downhole movement of said cammed grippers along their respective sloping surfaces.

8. The method of claim 7, comprising:

guiding the movement of said cammed grippers along their respective sloping surfaces.

9. A blowout preventer-mounted gripping device, comprising:

at least one ram block, said ram block supporting a gripper which allows selective removal of the tubular and grips the tubular if it moves in an opposite direction;

said ram block cams said gripper, along a sloping surface thereon, if the tubular exerts a force on said gripper in a downhole direction;

a biasing member to cam said gripper along said sloping surface toward an extended position where it can maintain contact with the tubular while the tubular is removed from the wellbore;

whereupon if the tubular begins to drop, the contact between said gripper and the tubular is enhanced by the force of said biasing member to force said gripper along said sloping surface, to stop the tubular.

10. The preventor of claim 9, wherein:

said gripper comprises serrations on a leading face thereof and said gripper is guided in its movement along said sloping surface.

11. The preventor of claim 10, wherein:

said at least one ram block comprises two opposing movably mounted ram blocks, each having an identically mounted gripper to create a circular opening through which the tubular can be removed or that both grippers can be wedged around the tubular it if moves in a downhole direction.

* * * * *